United States Patent [19]

Bodenmann et al.

[11] 4,196,564

[45] Apr. 8, 1980

[54] METHOD OF MANUFACTURING A JOINED CAPSULE FILLED WITH VISCOUS MATERIAL

[75] Inventors: Hans U. Bodenmann, Muenchenstein, Switzerland; Winand H. Martens, Belsele, Belgium

[73] Assignee: S.A. Capsugel A.G., Basel, Switzerland

[21] Appl. No.: 905,919

[22] Filed: May 15, 1978

[30] Foreign Application Priority Data

May 20, 1977 [DE] Fed. Rep. of Germany ..... 2722807

[51] Int. Cl.[2] ..... B65B 3/00; B65B 7/28

[52] U.S. Cl. ..... 53/471; 53/474; 156/305; 206/530

[58] Field of Search ..... 53/452, 454, 471, 472, 53/474, 485, 488; 206/530; 156/305, 274

[56] References Cited

U.S. PATENT DOCUMENTS

| | | | |
|---|---|---|---|
| 1,904,012 | 4/1933 | Reichard | 53/471 |
| 2,936,493 | 5/1960 | Scherer | 206/530 X |
| 3,653,500 | 4/1972 | Allisbaugh | 206/530 |
| 3,664,495 | 5/1972 | Graham et al. | 206/530 |

*Primary Examiner*—Travis S. McGehee

*Attorney, Agent, or Firm*—Stephen Raines; David B. Ehrlinger

[57] ABSTRACT

A method is provided of manufacturing a joined telescoping vented cap-and-body capsule filled with viscous material, comprising the steps of filling the viscous material into the body part, closing the filled body part with a layer of pasty sealing composition which is inert to the viscous material, telescoping the cap and closed body part, and sealing the inner side of the cap to the body part.

6 Claims, 6 Drawing Figures

METHOD OF MANUFACTURING A JOINED CAPSULE FILLED WITH VISCOUS MATERIAL

Figure 1:
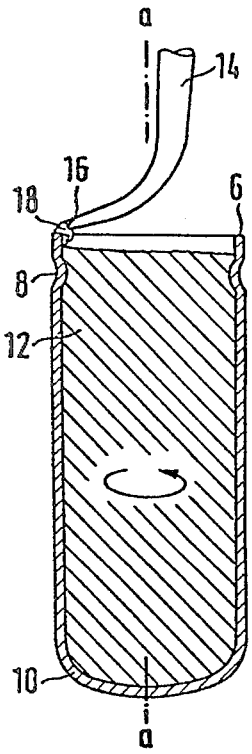
Figure 2:
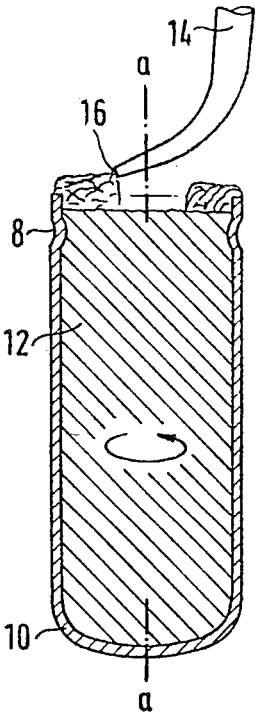
Figure 3:
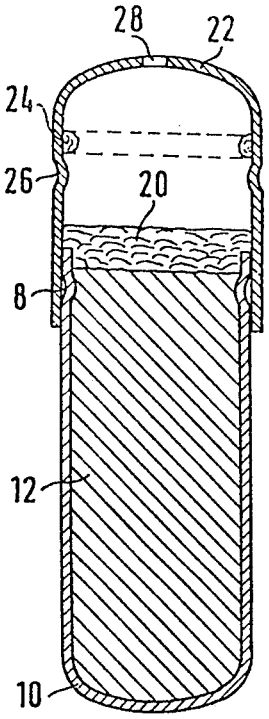

The invention relates to a method of manufacturing a joined capsule filled with viscous material, in particular a liquid pharamaceutical preparation, and having a body part and a cap telescoped thereon. The invention relates further to a joined capsule manufactured according to the said method.

Two basically different types of capsules for pharmaceutical perparations are commonly used: A hard-shell joined capsule and a capsule of relatively soft material. The hard-shell joined capsule consisting almost exclusively of gelatine has a body part (lower portion) and a cap (upper portion) telescoped thereon, and contains pharmaceutical preparations in solid form, such as powder, pellets etc. The soft-shell capsule generally consisting of gelatine and additional plastisizers contains pharmaceutical perparations in liquid form, such as suspensions, pastes and oils. The said two types of capsules intended predominantly for oral administation are filled with pharmaceutical preparations in different ways:

The hard-shell joined capsule can be filled by the manufacturer of the pharmaceutical preparation himself, e.g., by partly filling at first the body part with the powdery pharmaceutical preparation and then telescopically fitting a cap over the body part, wherein the closed-in air can be vented between body part and cap, and then the joining capsule can, if required, be provided with a band sealing the free end of the cap with respect to the outer wall of the body part.

Filling of the soft-shell capsules with liquid pharmaceutical preparation ist relatively complex since the soft-shell capsules are formed of two intimately bonded halves enclosing between them the liquid pharmaceutical preparation only at the moment when they are filled. These operations require a specific technique and are usually not performed by the manufacturer of the pharmaceutical preparation himself for this reason, which brings about considerable disadvantages also in view of the high demands made on quality and safety that have to be observed when manufacturing medicament capsules.

Presently, there ist no simple method according to which it is possible for the manufacturer of the pharmaceutical preparation himself to fill medicament capsules with a liquid pharmaceutical preparation. In the case of soft-shell capsules this cannot be realized because of the complex technique. In the case of hard-shell capsules sealing problems are encountered, for the liquid pharmaceutical preparation penetrates into the space between the outer wall of the body part and the inner wall of the cap and is prevented form leaking only by a band around the joined capsule.

In practice there is need not only for capsules filled with liquid pharmaceutical preparations, but quite generally, for capsules being filled with viscous, i.e., liquid or pasty materials. Such materials can be, for example, stain removing agents, solvents, volatile oils, liquid spices, silicon oils or chicken fat. Joined capsules are particularly suited to receive materials that must be carefully stored, e.g. airtight, so that they remain ready for use, and that are required in small amounts, i.e. in portions. The materials can become thinly liquid when heated and thickly liquid or even pasty when cooled.

It is an object of the invention to provide a method according to which joined capsules filled with viscous material can be manufactured in a simple manner by the manufacturer of the viscous material himself.

According to the invention this is achieved by a method of the kind set forth at the beginning in that the viscous material is filled in the body part, that the body part is closed at its open end with a layer covering the viscous material and consisting of a pasty, solidifying sealing composition being inert with respect to the viscous material, and that a cap is telescoped on the body part closed in such a manner.

Hence the method according to the invention starts from a prefabricated body part of a per-se known joined capsule. At first the viscous material is filled in said body part being open at one side. Then the surface of the viscous material is covered with a layer of sealing composition which enters an intimate bond with the inner side of the body part extending over the surface of the viscous material and which is advantageously applied such that no air is enclosed between the layer of sealing composition and the surface of the viscous material. Subsequently a cap is telescoped on said body part closed in such a manner and sealingly receiving the viscous material. It is taken care that the air enclosed in the interior of the cap can be vented, so that when telescoping the cap there is no considerable overpressure that could lift the cap off the body part. A joined capsule manufactured in this way is absoulutely tight as the sealing compositon that encloses the viscous material is arranged in a mechanically very stable area of the joined capsule, i.e. close to that area in which the cylindrical sidewall of the cap gradually becomes the bottom thereof.

For venting the air from the cap, the cap and the body part for example can be designed in such a manner that there is a vent channel between the outer side of the body part and the inner side of the cap.

The cap is preferably perforated at its closed end prior to being fitted over the body part. This way the air enclosed in the inside of the cap can directly vent through the aperture.

According to a development of the method the inner side of the cap is sealed with respect to the body part. Thus a particularly reliable tightness of the joined capsule is achieved.

The sealing between the inner side of the cap and the body part may for example be effected in that the layer is apllied such that it extends over the ridge of the body part. When, upon application of the layer, the cap is fitted over the body part, the projecting amount effects an intimate bond between the inner side of the cap and the body part.

Alternatively, the sealing between the inner side of the cap and the body part can be effected in that prior to telescoping sealing composition is applied to the cap in the area in which the ridge of the body part is to be positioned. Said sealing composition can be applied onto the inner side of the cap e.g. in the form of a ring, but the entire area of the inner side of the cap which is to be positioned in abutment against the outer side of the body part after the cap has been telescoped thereon, may as well be provided with sealing composition.

In case the cap and the body part consist of a material swelling when moist, it is sufficient to wet the inner side of the cap before it is telescoped onto the body part.

In a further development of the method the sealing between the inner side of the cap and the body part is effected in that after telescoping the cap onto the body part sealing composition is applied onto the inner side of the cap in the area of the ridge of the body part through the aperture formed in the closed end of the cap.

When filling the entire interior of the cap with sealing composition through the aperture after the cap was fitted on the body part, a mechanically particularly stable and reliable, tight joined capsule filled with viscous material is obtained preferably the aperture formed in the closed end of the cap is sealed after the cap was telescoped on the body part.

Hence the invention makes it possible to manufacture mechanically stable and reliably sealed joined capsules filled with viscous material in a simple manner. Said capsules can be made without air pockets, so that e.g. pharmaceutical preparations in liquid form that must not get into contact with oxygen or other viscous materials that set upon contact with air or become useless otherwise, are accomodated in a durable and reliable manner.

Even if there are dimensional tolerances of the body parts, joined capsules can be manufactured that are filled with an exactly defined amount of viscous mateial, as differences in the volumes due to dimensional tolerances can be compensated for by covering the viscous material with sealing compositon.

In case the joined capsule consists of gelatine, it is of advantage to also use gelatine as sealing composition. The gelatine enters an intimate bond with the material of the joined capsule, so that a stable and reliable sealing is provided after solidification. For pasty sealing compositions e.g. also dimethyl cellulose, starch, shellac, a solvent of cationic polyacrylate in isopropyl alcohol and acetone as well as further lacquers can be used that are commonly used for the bands of joined capsules or for the formation of a coating of joined capsules resistant to gastric juices. All materials can be used that enter an intimate bond with the material of the joined capsule, do not dissolve in viscous material, and show a minor shrinking effect when setting or solidifying. Of course, when the viscous material is a pharmaceutical preparation, the sealing material must be edible and not toxic.

Figure 4:
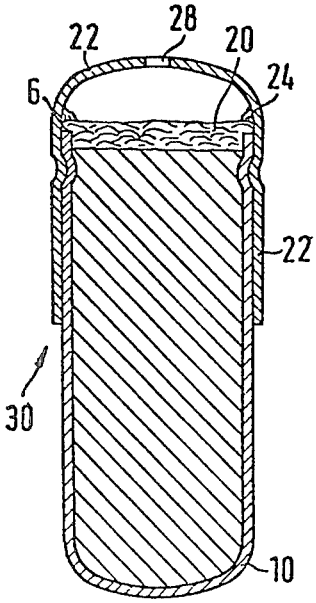
Figure 5:
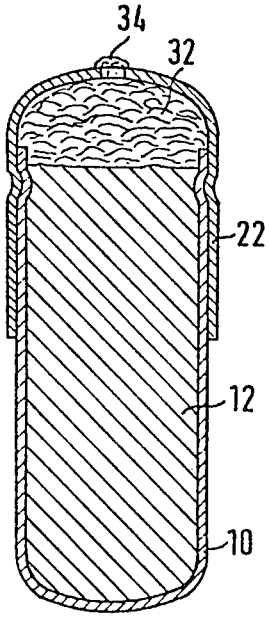
Figure 6:
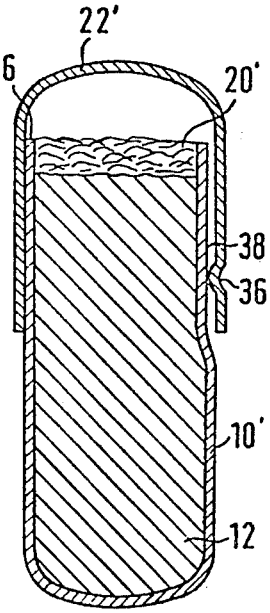

One example of the invention will now be described in more detail with reference to schematic drawings, in which FIGS. 1 to 5 show various method steps in the manufacture of a joined capsule filled with liquid pharmaceutical preparation and FIG. 6 shows a modified embodiment of a joined capsule.

FIG. 1 shows a body part 10 designed with a groove 8 in the proximity of its ridge and being filled with liquid pharmaceutical preparation 12 up to directly above the groove 8. The filling of the body part 10 with liquid pharmaceutical preparation 12 is not shown; it may be effected e.g. by means of a hollow filling needle.

Above the body part 10 filled with the liquid pharmaceutical preparation 12 a hollow needle 14 bent at its end is arranged in such a manner that the outlet opening 16 of the hollow needle 14 is directly adjacent the ridge 6 of the body part 10 and points radially outwardly. Then the body part 10 is slowly rotated about its axis a—a and a strand of pasty, solidifying sealing composition is extruded from the outlet opening 16 which in the form of a bead 18 is placed against the inner side of the body part 10 and the ridge 6 thereof. The groove 8 provides an additional backing for the bead 18.

Afterwards the hollow needle 14 is slowly moved in such a manner that the outlet opening 16 moves radially inwardly after the body part 10 performed at least one complete rotation, so that the bead 18 extends about the entire body part 10 in the shape of a ring. Thus the strand of sealing composition extruded from the outlet opening 16 forms a spirally ring-shaped bead covering the surface of the pharmaceutical composition 12. The consistency of the sealing composition has been chosen such that it sufficiently adheres together and to the body part 10 so that the layer of sealing composition formed by the spirally inwardly extending ring-shaped bead above the surface of the pharmaceutical preparation 12 does not break and, e.g. sink in the pharmaceutical preparation. The specific weight of the sealing composition in addition can be provided such that it is slightly below that of the pharmaceutical preparation 12. When forming the layer 20 of sealing ccomposition fully shown in FIG. 3 and overlying the ridge 6 and the liquid pharmaceutical preparation 12, it must be observed that the outlet opening 16 of the hollow needle 14 on the one hand is moved radially inwardly up to the axis a—a of the body part 10 at not too large a distance from the surface of the liquid pharmaceutical preparation 12, so that no air pocket forms between layer 20 and pharmaceutical preparation 12 and, on the other hand, is moved radially inwardly not too close to the surface of the pharmaceutical preparation 12, so that the layer 20 does not submerge into the pharmaceutical preparation 12 and is not covered by the liquid pharmaceutical preparation itself.

After the layer 20 has been finished the hollow needle 14 is removed and a cap 22 is fitted over the body part 10 closed by the layer 20. Before that said cap, in the area in which the ridge 6 of the body part 10 is to be located, was coated, with a bead or strip 24 of sealing composition, e.g. by means of a hollow needle similar to the hollow needle 14 or by means of a sprayer. In the embodiment shown, the cap 22 also has a groove 26 which snaps in the groove 8 of the body part 10 when the cap 22 is completely telescoped onto the body part 10, so that a rigid mechanical connection between body part 10 and cap 22 is established. The air urged out of the interior of the cap 22 when telescoping the cap 22 onto the body part 10 can be vented through an aperture 28 provided in the closed end of the cap.

FIG. 4 shows a joined cpsule with a cap 22 completely telescoped onto the body part 10. Said joined capsule 30 is reliably tight as the strip 24 of the sealing composition introduced in the cap 22 was additionally smeared at the inside of the cap 22 by the ridge 6 of the body part 10 or the sealing composition on the ridge 6 and formed a bond with the layer 20.

According to FIG. 5, the entire interior of the cap 22 can be filled with sealing composition 32 through the aperture 28 e.g. by moving a hollow needle through the hole 28 into the cap 22 and slowly moving it out of the aperture 28 while extruding sealing composition. Thus, a projecting plug 34 of sealing material remains at the aperture 28 which forms a positive bond with the edge of the aperture 28.

FIG. 6 shows a modified embodiment of a joined capsule. Said joined capsule has a body part 10' formed without the groove 8 of FIG. 1 and filled with liquid pharmaceutical preparation. The liquid pharmaceutical preparation 12 is shown there in a simialar manner as in FIGS. 1 and 2 covered by a layer 20' of sealing material which in this case does not extend over the ridge 6 of the body part 10, though. A cap 22' is telescoped on the body part 10' which, in contrast to cap 22 of FIGS. 1 to 5 has two or more lateral indentations 36 arranged at equal angular distances, of which indentations only one is shown. Said indentations 36 slightly compress the body part 10' so that between the inner side of the cap 22' and the outer side of the body part 10' vent channels 38 are formed through which air enclosed in the inside of the cap 22' can be vented when telescoping the cap 22' onto the body part 10'. With this embodiment the layer of sealing composition 20' is not applied in such a manner that it extends over the ridge 6 of the body part 10' as there would be the danger that the vent channels 38 are barred by sealing composition when telescoping the cap 22' onto the body part 10'. Because of said vent channels 38 the cap 22' can be formed without an aperture in the closed end. Of course the cap 22' could be provided with a ring of sealing composition similar to the ring 24 according to FIG. 3 in the area of its inner side in which the ridge 6 of the body part 10' is to be located, prior to being telescoped onto the body part 10', so that the finished joined capsule is sealed also in the area between the inner side of the cap 22' and the outer side of the body part 10'.

We claim:

1. A method of manufacturing a joined capsule filled with viscous material, in particular a liquid pharmaceutical preparation, the capsule having a body part with an open end and surrounding ridge and having a cap with a venting aperture, telescoped on the body part, characterized in that the viscous material is filled in the body part, the body part is closed at its open end with a layer covering the viscous material, of a pasty, solidifying sealing composition being inert with respect to the viscous material, the cap is telescoped on the body part closed in such a manner, and the inner side of the cap is sealed with respect to the body part.

2. The method as claimed in claim 1, characterized in that the layer is applied in such a manner that it extends over the ridge of the body part.

3. The method as claimed in claim 1, characterized in that the cap is provided with sealing composition in the area in which the ridge of the body is to be positioned, prior to telescoping.

4. The method as claimed in cliam 1, characterized in that after telescoping the cap sealing composition is applied through aperture onto the inner side of the cap in the area of the ridge of the body part.

5. The method as claimed in claim 4, characterized in that the entire interior of the cap is filled with sealing composition through the aperture after the cap is telescoped.

6. The method as claimed in claim 5, characterized in that the aperture is sealed after the cap is telescoped.

* * * * *